United States Patent [19]

McBain et al.

[11] Patent Number: 4,803,037

[45] Date of Patent: Feb. 7, 1989

[54] PIPE QUENCHING APPARATUS

[75] Inventors: Robert M. McBain; Garry J. Becze, both of Sault Ste. Marie; Friedrich W. Kruppert, Goulais River, all of Canada; Jack W. Leistner, Greenville, S.C.

[73] Assignee: The Algoma Steel Corporation, Limited, Sault Ste. Marie, Canada

[21] Appl. No.: 77,595

[22] Filed: Jul. 24, 1987

[51] Int. Cl.[4] ..... C21D 9/08

[52] U.S. Cl. ..... 266/78; 266/117; 266/259; 266/274

[58] Field of Search ..... 266/114, 259, 85, 78, 266/90, 117, 111-113, 274

[56] References Cited

U.S. PATENT DOCUMENTS

| | | | |
|---|---|---|---|
| 2,807,272 | 9/1957 | McCray | 134/167 |
| 2,888,374 | 5/1959 | Heinenberg | 148/21.55 |
| 3,212,766 | 10/1965 | Heinenberg et al. | 266/6 |
| 3,623,716 | 11/1971 | Fritsch et al. | 266/6 R |
| 3,877,685 | 4/1975 | Franceschina et al. | 266/4 R |
| 3,915,763 | 10/1975 | Jennings et al. | 148/127 |
| 3,997,375 | 12/1976 | Franceschina et al. | 148/143 |
| 4,050,963 | 9/1977 | Kunioka et al. | 148/128 |
| 4,116,716 | 9/1978 | Itoh et al. | 134/134 |
| 4,376,528 | 3/1983 | Ohshimatani et al. | 266/114 |
| 4,575,054 | 3/1986 | Kruppert | 266/114 |

FOREIGN PATENT DOCUMENTS

| | | |
|---|---|---|
| 862019 | 1/1972 | Canada . |
| 1016048 | 8/1977 | Canada . |

*Primary Examiner*—Christopher W. Brody

*Attorney, Agent, or Firm*—Merchant, Gould, Smith, Edell, Welter & Schmidt

[57] ABSTRACT

An improved method and apparatus for quenching elongated steel pipe in a liquid cooling medium substantially improves the straightness of the finished product. After being heated to an initial temperature higher than the austenite transformation temperature, the pipe is positioned within an enclosure formed by mating semi-cylindrical shell members. Two streams of coolant are introduced to flow through the interior of the pipe, and over the exterior of the pipe, respectively, the relative volumes of flow of the two streams of coolant being regulated to ensure substantially uniform rates of cooling as between the interior and exterior surfaces of the pipe.

10 Claims, 9 Drawing Sheets

PIPE QUENCHING APPARATUS

FIELD OF THE INVENTION

The present invention relates to the quench hardening of long steel pipe or tube sections, and in particular, to an improved method and apparatus for quenching elongated steel pipe sections in a liquid cooling medium.

The term "liquid cooling medium" or "cooling medium" as it hereinafter appears in the specification including the claims, is intended to include not only liquids but also any substantially liquid mixture of one or more liquids, gases and vapors.

BACKGROUND OF THE INVENTION

Steel pipe of the type used, for example, in oilfields, is sometimes subject to severe mechanical stress and stress corrosion. Proper quenching of the pipe after it has been formed tends to increase the resistance of the pipe to failure. It is known to quench this type of pipe by immersing it in a bath of liquid cooling medium, such as water, and causing the liquid cooling medium to flow both through the interior of the pipe and around the exterior of the pipe in controlled proportions, hereinafter referred to as "inside-outside" quenching.

This inside-outside quenching technique, and apparatus for practising same, are the subject of U.S. Pat. Nos. 3,997,375 and 3,877,685, and corresponding Canadian Pat. No. 1,016,148, granted to the assignee herein. Briefly summarized, the method comprises supporting the hot pipe horizontally in an elongated tank and passing part of the liquid cooling medium flow (typically water) from an inlet nozzle directly through the inside of the pipe and passing another part of the cooling medium flow directly from the inlet over the outside of the pipe. The relative proportions of the flow of cooling medium from the inlet directly through the pipe and of the flow over the outside of the pipe are varied to achieve a desired hardening effect. Typically, the desired effect is substantial uniformity of hardness as between the inside and outside surfaces of the pipe, as is required by some oil industry specifications.

Suitable apparatus of this known type may comprise an elongated tank dimensioned to receive the hot pipe section to be quench-hardened, and fins or other suitable supporting elements for supporting the hot pipe section horizontally in the tank and spaced from the bottom of the tank to permit adequate water flow around the pipe section. A nozzle having a tip, for introducing water into the pipe section is connected to a water supply. The nozzle is mounted for moving the nozzle between a retracted position in which the tip is spaced from one end of the pipe (to allow insertion and removal of the pipe section into and from the container without interfering with the nozzle), and an extended position in which the tip lies within the end of the pipe section (so as to direct water flow in a concentrated stream into the interior of the pipe section). The inlet and nozzle arrangement is configured to direct a flow of water also around the outside of the pipe section. Since varying pipe diameters and variation in other operating parameters may require some variation in relative interior/exterior water flow in order to maintain uniform inside/outside hardness of the quenched pipe section, suitable valving arrangements are provided to vary the proportion of water entering through the nozzle into the interior of the pipe section relative to the proportion of water passing over the outside of the pipe section, so as to control the rate of cooling of the inside surface relative to the outside surface of the pipe section. Conventional lifting arms or other means for removing the pipe from the elongated tank after quenching are also provided. This apparatus constitutes an improvement of earlier known apparatus described in U.S. Pat. No. 3,623,716 granted to Mannesmann Tube Company Ltd.

The inside-outside quenching method and apparatus are described in detail in the above-mentioned patents, the disclosures of which are hereby incorporated herein by reference.

One of the visible problems associated with conventional immersion quenching of pipe is "warping", or lack of straightness, in the quenched pipe. In immersion quenching, a container filled with a cooling medium receives a hot pipe section dropped or lowered into the medium before coolant is injected into the interior of the pipe.

In order to harden low alloy steels effectively, each region of the metal, whether interior or close to the surface, must be cooled from its austenitizing temperature (typically 1600° F.) to its Ms temperature (typically 500° F.) within a matter of seconds and in an uninterrupted manner once quenching commences. One of the inherent deficiencies of immersion quenching is that it entails a transient immersion quench period which makes up a substantial part of the duration of contact between the pipe and the cooling medium. This transient immersion quench period (or "slack quench") occurs from the time of the first contact of the pipe with the surface of the cooling medium to the time when full steady state quench flow is established.

From the moment the pipe first contacts the cooling medium in a substantially horizontal position, the cooling medium flows freely but relatively slowly into the inside of the pipe while air is escaping therefrom. The cooling of the inside pipe surface occurs by conductive heat transfer through a vapour blanket and is of the order of 1/10 the cooling rate at full turbulent flow, and is non-uniform as some portions of the inside pipe are first contacted by cooling medium substantially in advance of other portions.

The initial slow cooling described above occurs during the period in which the pipe moves to the bottom support of the tank, is secured in position, a nozzle for the introduction of coolant into the interior of the pipe is advanced into the end of the pipe, and a valve is actuated to release coolant through the nozzle, before full turbulent flow can flush out the pool of cooling medium which has entered the inside of the pipe from one or both ends. Portions of the inside of the pipe in contact with this pool will not be fully hardened and, owing to premature transformation, will tend to cause distortion of the pipe.

It has been found by experimentation that a further characteristic of conventional immersion quenching is that outside quench effectiveness does not match inside quench effectiveness, with differential hardening of the pipe as a result. The differential of volumetric expansion between the exterior portions and the interior portions of the pipe occurring during quenching not only tends to create distortion, but also creates severe internal stresses giving rise to the possibility of cracking of the finished pipe in use with certain chemical compositions. The mismatch between inside and outside quench effectiveness that arises in conventional immersion quenching is especially pronounced in the case of small-diameter, small bore tubing. External quenching of the pipe is conventionally effected simply by the free flow of cooling medium in the open tank over the outer surface of the tube. As progressively smaller sizes of pipe are quenched, the outside cooling efficiency of the available volume of cooling medium free flowing in the open tank decreases, making quenching of small diameter, small bore tubing quite impractical since the effectiveness of the inside quench (effected by means of a suitable nozzle injecting cooling medium into the pipe at a substantial pressure) cannot be properly matched to the outside cooling efficiency.

As is well known, the quenching process is attended by volumetric changes in the steel, for example the expansion attendant on the martensitic transformation, and it is believed that the warping problem encountered in practice, results from non-uniformity in the cooling of the workpiece, leading to non-uniform volumetric change rates. For given quenching apparatus, it has been found that the non-straightness problem appears more serious for pipe diameters at the low and high ends of the range of diameters for which the apparatus is used, and less serious for intermediate diameters. It is suspected that part of the problem with small diameters results from the restricted interior dimension impeding the flow of the quenching medium inside the pipe, resulting in a less satisfactory inside quench; the problem with larger diameters results largely from coolant partially filling the inside of the pipe before a full steady state inside flow is established and partly from the volume of flow of coolant relative to the inner and outer surface areas of the pipe being smaller than is the case when intermediate diameters are quenched using the same apparatus.

Previously disclosed apparatus and methods for immersion quenching purport to eliminate problems with the non-straightness of pipe by a number of expedients. One such approach aims to eliminate the non-straightness problem by commencing the internal quench very shortly after the pipe is rigidly clamped at spaced positions along its entire length to restrain it from warping. This approach is exemplified in the teachings of U.S. Pat. No. 4,116,716 (Itoh). There is a risk that simply restraining the pipe from warping during a non-uniform quench may have the undesired effect of preventing the natural relief of internal stresses occurring during warping and, as a result, inducing active stresses during the quenching process and residual stresses therafter.

It has also been proposed to eliminate problems with the non-straightness of pipe in an immersion quenching technique by commencing the internal and external quench very shortly after the pipe has been introduced into a coolant-filled tank containing a housing for holding the pipe in position during the quenching process. The Ohshimatani U.S. Pat. No. 4,376,528 teaches that it is preferable that the housing for inside-outside quenching be itself submerged in cooling water in the quench tank before the hot pipe is introduced into the housing so that the cooling water functions as a damping medium to reduce the speed of approach of the dropping steel pipe to the housing. It is further suggested by Ohshimatani that dropping the hot pipe into water for a period of time before injecting coolant eliminates soft spots in the hardened steel because cooling water instantaneously enters the steel pipe. Applicants' experience with inside-outside quenching of pipe indicates that the above teaching of Ohshimatani points in entirely the wrong direction. The "slack quenching" that occurs even during a very brief period of submersion of a hot pipe in stationary coolant is unsatisfactory for the reasons discussed above.

SUMMARY OF THE INVENTION

The apparatus of applicants' invention includes a cylindrical enclosure formed by mating semi-cylindrical shell members and support means disposed within the enclosure to support a heated pipe section in a position radially spaced from the interior surface of the enclosure, such that liquid cooling medium from the injection means of an inside-outside quench unit may flow over the exterior of the pipe through the space between the exterior of the pipe and the interior surface of the enclosure.

As will be apparent from the following description, in the method of applicants' invention, the uniform quenching of pipe takes place entirely inside the enclosure formed by mating semi-cylindrical shell members. It is an important feature of the method of applicants' invention that no coolant need contact the hot pipe section until the initiation of high-volume turbulent flow of coolant simultaneously inside the pipe and through the annular space therearound, at relative volume flows of coolant that are approximately equal inside and outside the pipe.

Quench uniformity, outside quench effectiveness, and resulting straightness of pipe quenched in an inside-outside quenching process can all be substantially improved according to the invention by the simultaneous injection of cooling medium under pressure into the inside of the pipe section to be quenched, and into an enclosed annular region around the exterior of the full length of the pipe section without permitting the hot pipe section to be initially immersed in coolant. The annular region containing the flow over the outside surface of the pipe section is concentric with the pipe axis and is appropriately dimensioned for the diameter of the pipe quenched.

By containing the exterior flow of cooling medium over the outside pipe surface within an annular region about the pipe, a higher outside quench efficiency is achieved. Further, the simultaneous injection of cooling medium into and over the outer surface of a non-immersed pipe section ensures that fully steady state flow is achieved virtually instantaneously and that each volumetric element of the pipe section is quenched at the maximum cooling rate.

The quench-hardening of an elongated steel pipe section according to the method of the invention has been effected by using a first form of cylindrical housing apparatus in association with an inside-outside quench unit such as that disclosed and claimed in U.S. Pat. No. 3,877,685. That prototypical form of cylindrical housing apparatus is described in detail below. However, the currently preferred apparatus for effecting the method of the invention comprises, in combination:

Apparatus for hardening an elongated steel pipe section by quenching with a liquid cooling medium, comprising in combination:

(a) a source of liquid cooling medium;

(b) a hollow elongated enclosure of cylindrical configuration of length greater than the length of a pipe section to be quenched and of inside transverse dimensions greater than the outside diameter of such pipe section, and openable to receive such length of pipe, said enclosure comprising an upper substantially semi-cylindrical shell and a lower shell operable to be assembled in mating engagement to form a substantially cylindrical enclosure and operable to be separated into an open configuration in which one shell is displaced from the other a sufficient distance to facilitate the introduction of a pipe into the apparatus;

(c) injection means for introducing cooling medium from said source to flow through the interior of a pipe section supported within said substantially cylindrical enclosure in linear alignment with said injection means, and to flow over the outside surface of such aligned pipe section over the outside surface thereof through the space between the exterior of such aligned pipe section and the interior surface of said enclosure;

(d) supporting means operable to support such pipe section within said substantially cylindrical enclosure in axial alignment with said injection means;

(e) means for regulating the rate of flow of cooling medium through the inside of a pipe section received in said substantially cylindrical enclosure in axial alignment with said injection means, relative to the rate of flow of cooling medium over the outside surface of such pipe section;

(f) pipe handling means operable to receive a hot pipe section to be quenched and to deposit such pipe onto said supporting means with said enclosure in the open configuration, to retract from said supporting means to a position in close proximity to the inner surface of said lower shell when said upper and lower shells are assembled to form said substantially cylindrical enclosure, thereby leaving such pipe section supported on said supporting means, and to lift said pipe section free of said enclosure when said upper and lower shells are separated into said open configuration; and (g) means for securing a pipe section supported on said supporting means within said cylindrical enclosure against longitudinal displacement by cooling medium introduced into said cylindrical enclosure by said injection means.

DETAILED DESCRIPTION

While the method of the invention may be practiced using many different designs of apparatus, understanding of the invention may be facilitated by the following detailed description of (1) apparatus which has been used in conjunction with an inside-outside quenching unit of the kind disclosed in U.S. Pat. No. 3,877,685, and (2) the currently preferred apparatus used to perform the method of the invention. In the accompanying drawings:

FIG. 1 is a top plan view of a portion of a cylindrical enclosure used to enclose the pipe to be quenched, and adapted for use in conjunction with a known inside-outside quench unit of the kind disclosed in U.S. Pat. No. 3,877,685;

(1) Prototype Cylindrical Enclosure Used with a Known Inside-Outside Quench Unit As indicated above, a known quench unit suitable for use in carrying out the method of the invention comprises an elongated container dimensioned to receive a hot pipe section to be hardened (hereinafter referred to as a "quench tank"), means for supporting the hot pipe section in a predetermined position in the quench tank, injection means such as that disclosed and claimed in U.S. Pat. No. 3,877,685, operable to inject cooling medium in variable proportions into and through the pipe and over the outside of the pipe, and means for removing the pipe from the quench tank subsequent to hardening.

When the method is carried out using the cylindrical housing apparatus of the invention in association with the aforementioned known quench unit, the quench tank of the unit is empty immediately prior to commencement of the quenching operation and serves to receive the outflow of coolant from the open ends of the pipe section and cylindrical housing remote from the injection means of the quench unit. From the quench tank, coolant that has passed through or over the pipe section can be removed for recycling. There is no requirement that the level of coolant in the tank be maintained at any particular level during quenching, but it is preferred that the level be below the cylindrical housing positioned in the tank, so that the enclosed pipe is quenched only by cooling medium from the injection means of the quench unit. Rather than requiring a hot pipe to settle in substantially quiescent coolant before full quenching can commence, instead, according to the method of the present invention, the heated pipe section remains dry at austenitizing temperature until coolant valves are opened to allow immediate full quenching flow to be established along the pipe length.

Figure 1:
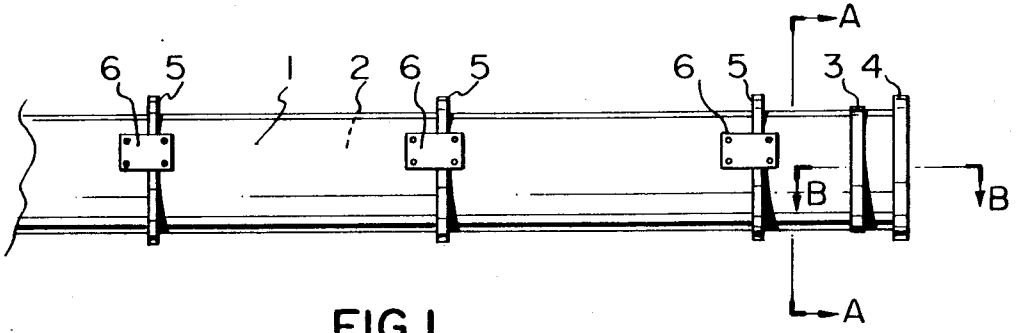
Figure 2:
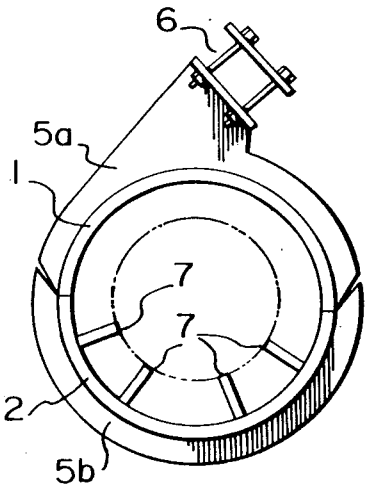
FIG. 2 is a cross-sectional elevation along the line A—A of FIG. 1.
Figure 3:
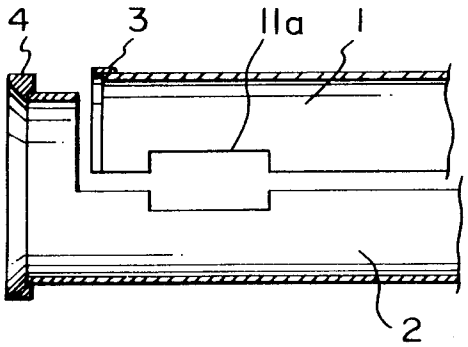
FIG. 3 is a cross-sectional elevation along the line B—B of FIG. 1.
Figure 4:
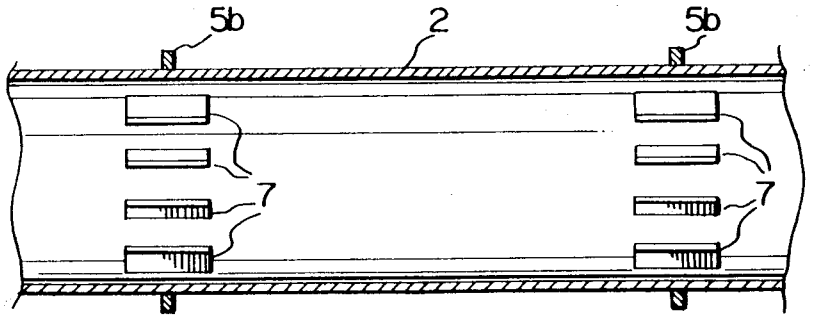
FIG. 4 is a top plan view of a portion of the lower semi-cylindrical enclosure member of the cylindrical enclosure of FIG. 1.

Referring now to FIGS. 1–5, the prototype apparatus which was first used to practise the method of this invention, in a known and existing inside-outside quench unit, comprises two semi-cylindrical shell members 1 and 2. Member 1 is a half-cylinder, terminating in a cover plate 3, in the form of a half ring. Shell member 2 comprising a mating half-cylinder, with a short cylindrical end portion, terminating in adaptor ring 4, as best shown in FIG. 3, in which the two shell members 1, 2 are shown slightly separated, for clarity of illustration. The two shell members may conveniently be formed by cutting a pipe of suitable dimensions. The outer diameter of adaptor ring 4 is dimensioned to fit closely within the coolant inlet means 10*a* of the inside-outside quench unit 10 so that the flow of coolant pumped under pressure over the outside of a pipe being quenched will be confined within the cylindrical enclosure, i.e. in the annular space between the cylindrical enclosure and the pipe being quenched.

The inside-outside quench unit in association with which the applicants' cylindrical enclosure of FIGS. 1–5 has been used is essentially as described in U.S. Pat. No. 3,877,685. As indicated in that patent, the elongated horizontal tank and the mechanisms for delivering a hot pipe section to the tank, retaining it in the tank at a predetermined height and subsequently removing it from the container are conventional and are as disclosed in U.S. Pat. No. 3,623,716. The associated inside-outside quench unit comprises an elongated horizontal tank, coolant inlet means at one end of the tank including an outer conduit and a concentric inner nozzle, the nozzle being pneumatically extendible to a working position, and pneumatically operated pipe gripping arms, to grip the end of a pipe section and retain it in appropriate orientation with respect to the nozzle and surrounding annular coolant inlet. The nozzle and surrounding inlet are in communication with a source of liquid coolant, namely water, and means are provided for adjusting the relative rates of flow of water through the nozzle, and through the surrounding annular inlet when the unit is in operation. The unit is provided with pipe handling apparatus, in the form of a plurality of pivoting arms, extending generally transversely of the tank, at spaced locations therealong.

As shown in the drawings, the enclosing cylinder apparatus of the illustrated prototype of the present invention is provided with a plurality of exterior split support rings 5, each comprising an upper half ring 5*a* and a lower half ring 5*b*, affixed to the upper and lower shell members respectively, at spaced locations matching the locations of the quench unit pipe handling arms. Each upper half-ring 5*a* is provided with clamp means 6, adapted to clamp upper half rings 5*a* to the pipe handling arms of the quench unit.

Depending on the dimensions of the quench tank, the dimensions of the enclosing cylinder, and the location of the coolant inlet in the tank, it may be necessary to provide lower shell member 2 with suitable support structures which might conveniently be attached to lower half-rings 5*b*, to support it in proper alignment within the tank.

The lower shell member is provided with a plurality of positioning elements, in the form of steel plates 7, welded to the inside surface of the lower shell member, and projecting radially inwardly, as shown. Elements 7 are located in a plurality of assemblies at longitudinally spaced locations, so that when the upper and lower shell members are matingly engaged to form a cylindrical enclosure, elements 7 form a plurality of semicircular assemblies, defining an unobstructed central circular space (shown in dotted outline in FIG. 2) of a diameter to receive a pipe section to be quenched.

Figure 5:
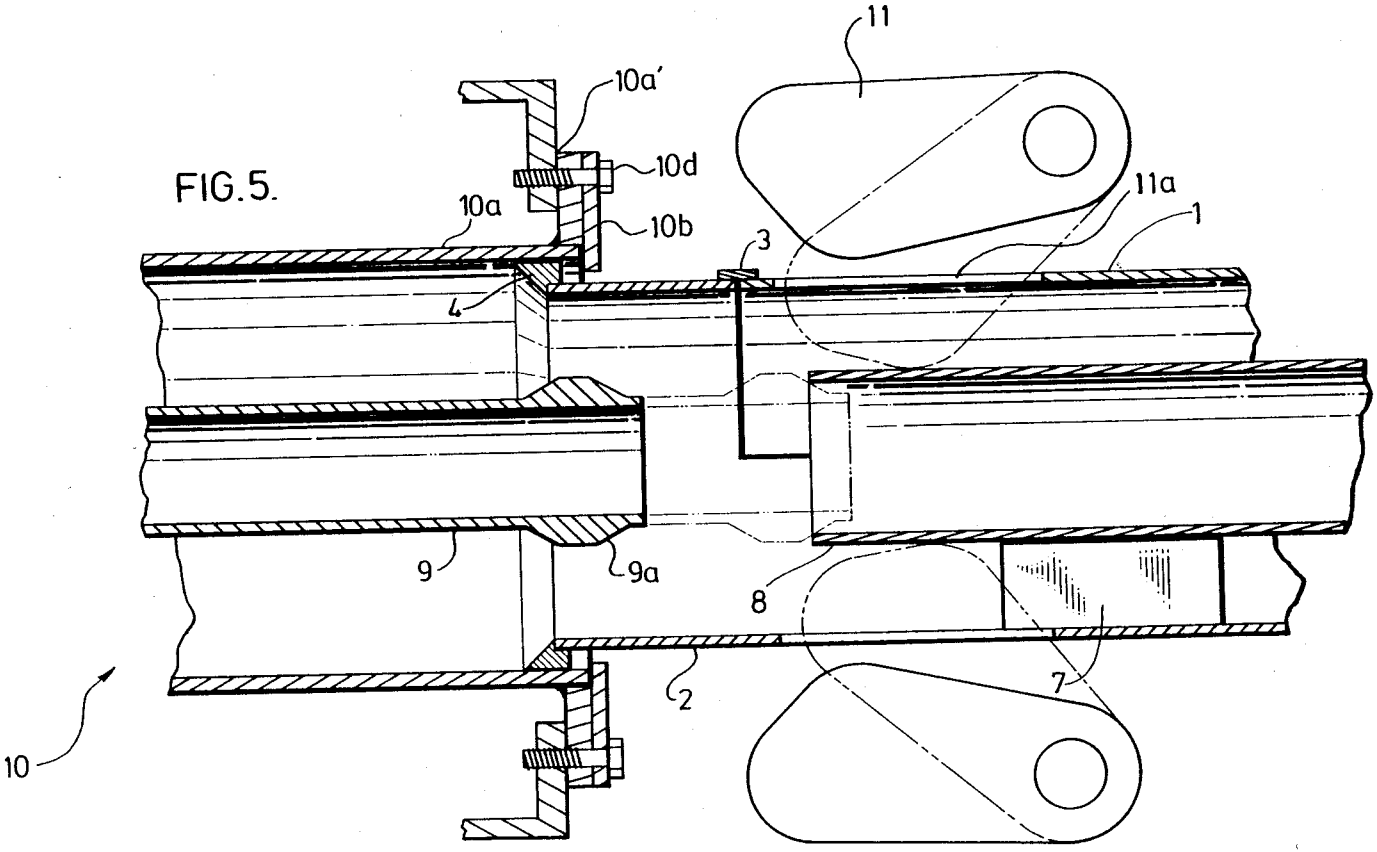
FIG. 5 is a cross-sectional plan view in the direction C′—C′ of a portion of the cylindrical enclosure, further showing the engagement of one end of the enclosure with the coolant injection means of an inside-outside quenching unit used in association with the apparatus and the positioning of a pipe to be quenched, and the operation of the pipe holding clamps of the quenching unit.

In operation, lower shell member 2 is positioned in the quenching tank, with adaptor ring 4 located at the end of the tank where the coolant inlet is located, and fitting closely within the inlet. Upper shell member 1 is mounted on the pipe handling arms of the quench unit, by means of clamp 6, in such a position that downward movement of the pipe handling arms will lower shell member 1 into mating engagement with shell member 2. The ends of half-rings 5*a* and 5*b*-are angled, as shown in FIG. 2, to guide shell member 1 into mating engagement with shell member 2, when it is lowered into position. A hot pipe section is deposited in lower shell member 2, being supported by positioning elements 7. The coolant nozzle 9 and pipe centering and holding clamps 11 of the quench unit are extended to their working positions, to enter the end of the pipe section and to grip the end of the pipe section, respectively, as illustrated in FIG. 5. As best seen in FIG. 3, shell members 1 and 2 are provided with cut out portions forming a pair of opposed lateral slots, 11*a* to accommodate pipe centering and holding clamps 11, shown in the unclamped (solid outline) and clamping (dotted outline) positions. Upper shell member 1 is then lowered into mating engagement with lower shell member 2, by means of the quench unit pipe handling arms.

The engagement of the enclosing cylinder apparatus, the pipe section housed therein and the cooling inlet means of the quench unit in association with which this apparatus has been used are illustrated in FIG. 5. Hot pipe section 8 is axially aligned within the cylindrical housing by positioning elements 7 of lower shell member 2. Extendible coolant nozzle 9 is shown in solid outline in its retracted position and in dotted outline in its extended working position. Nozzle 9 presents a bevelled ring member 9*a* on its outer surface. When the nozzle is in its working position within the end of pipe section 8, ring member 9*a* seals against the end of the pipe section 8 to put the nozzle and pipe interior into substantially isolated fluid communication.

The terminal adaptor ring 4 of the lower shell cover fits closely within the inner surface of outer conduit 10, having a maximum clearance of about ⅛ inch therefrom, so that when upper shell member 1 has been lowered into mating engagement with lower shell member 2, the annular space between the pipe section and the surrounding enclosure is in substantially isolated fluid communication with the flow of liquid from outer conduit 10 through the annular inlet surrounding nozzle 9.

During quenching, the cylindrical housing formed by shell members 1 and 2 is held in position longitudinally by a split ring arrangement, affixed around the perimeter of the coolant inlet means after the cylindrical housing is fitted within the coolant inlet means, as illustrated in FIG. 5. Split ring 10*b* is bolted to the housing 10*c* of quench unit 10 by bolts 10*d*. Under pressure of the quenching liquid flowing through inlet 10*a* into the cylindrical housing, adaptor ring 4 is forced against split ring 10*b*, thereby preventing longitudinal movement of the cylindrical housing.

With the coolant nozzle extended to its working position, quenching water is pumped through the interior of the pipe section via the nozzle, and through the annular space between the pipe section and the surrounding enclosure, via the annular inlet surrounding the nozzle, until quenching is complete. Upper shell member 1 is then lifted away from lower shell member 2 by the pipe hanlding arms, and the quenched pipe section is removed from the lower shell member, and conveyed away for tempering or such other further processing (if any) as may be required.

As previously explained, adaptor ring 4 must have a sufficiently large outer diameter to fit closely within the coolant inlet means of the quenching unit. The other dimensions of the enclosing cylinder are, naturally, dependent on the dimensions of the size of pipe to be quenched. The cylinder must, of course be sufficiently long to enclose the entire length of the pipe section being quenched, and must be of an internal diameter sufficient to provide an annular space of reasonable dimensions around the pipe section. That is, the annular space must be sufficiently large to permit an appropriate volume of water flow at available pressure. It will be understood that, for a given volume of water flow, a smaller size of annular space will correspond to a higher velocity of water flow, other things being equal. As an example, an enclosing cylinder having an internal diameter of approximately 12", having positioning elements in the form of half inch plates approximately 2½" wide and 6" long, the assemblies of positioning elements being located on 5' centers, has been found suitable for the quenching of 7" outside diameter pipe.

As indicated earlier, it has been found that the rapid, simultaneous and uniform quenching of the inside and outside surfaces of a pipe section is necessary for ensuring a consistent yield of straight pipe. This is achieved with the cylindrical enclosure apparatus of FIGS. 1–5 in conjunction with the aforementioned known inside-outside quench unit by commencing quenching of the inner and outer surfaces simultaneously with flows of liquid coolant at sufficient surface velocities relative to the pipe to ensure turbulent breakup of the boundary film of vapour formed when the coolant contacts the hot pipe section. The means for varying the relative volumes of inside and outside flows of coolant should be pre-adjusted so that the two volume flow rates are approximately equal when quenching is commenced, although the flow around the outside of the pipe section may be set somewhat larger than that inside the pipe, to compensate for the greater surface area and to equalize the rates of removal of heat from the inner and outer pipe surfaces as nearly as possible.

"Slack" quenching of the pipe section, and its attendant disadvantages as discussed above, are avoided by ensuring that the cylindrical enclosure holding the hot pipe section is not itself submerged in liquid coolant prior to or during the quenching process. Accordingly, the cylindrical housing apparatus of FIGS. 1–5 could be used in association with an inside-outside quench unit in which the outflow of coolant from the open ends of the housing and enclosed pipe section is received into an external reservoir or otherwise conveyed away for recycling. The containment of the housing within a tank is not essential, as the hot pipe section need not be immersed in quiescent liquid cooling medium at any stage of the quenching process.

Applicants' experience has shown that with a suitably dimensioned cylindrical enclosure as described above, inner and outer volume flow rates of about 4,500 U.S. gallons per minute (when water is used as the coolant) are sufficient to break up the vapour boundary film and produce straight pipe for tubing having wall thickness up to ½ inch and outer diameters falling in the range of 4½ inches to 10¾ inches.

As will be apparent from the foregoing description, the uniform quenching of pipe takes place entirely inside the enclosure formed by shell members 1 and 2. No coolant contacts the hot pipe section until the initiation of high-volume turbulent flow of coolant simultaneously inside the pipe and through the annular space therearound, at relative volume flows of coolant that are approximately equal inside and outside the pipe. When the method is carried out using the cylindrical housing apparatus of FIGS. 1–5 in association with the known quench unit described above, the quench tank of the unit is empty immediately prior to commencement of the quenching operation. There is no requirement that the level of coolant in the tank be maintained at any particular level during quenching.

In some cases, it may also be necessary or desirable to connect an auxiliary source of quenching water to the annular space between the enclosing cylinder and the pipe being quenched. This can easily be accomplished by providing one of the shell members with one or more suitable apertures and pipe fittings, to be connected to such an auxiliary source of quench water.

On the basis of experience to date, it is considered that the enclosed cylinder quenching method and apparatus described herein, may be used to overcome the straightness problem previously encountered in the inside-outside quenching of long steel tubing, particularly tubing of diameters at the upper and lower ends of the range of pipes for which the quenching unit is designed, without sacrifice of quality.

It will be understood that, while the particular apparatus described above utilizes a plurality of substantially planar assemblies of radially oriented positioning elements, other configurations of the array of positioning elements are possible, provided that the elements are so configured, dimensioned, spaced and located, as to support the pipe on the quench axis, while at the same time permitting an adequate flow of coolant over the outside surface of the pipe.

It would also be possible to utilize an enclosure of a configuration different from the circular cylinder of the particular embodiment described, provided that effective, smooth, concentrated interior and exterior coolant flows are available.

Similarly, while the illustrated prototypical embodiment comprises positioning elements in the form of substantially rectangular plates oriented in radial planes of the pipe, many other forms of positioning elements are possible. As a particular example, persons familiar with the inside-outside quenching process will be aware that the nozzle through which coolant is pumped into the interior of the pipe, may be provided with deflectors or other means, for engendering a helical or spiral flow of coolant through the interior of the pipe, rather than a substantial straight longitudinal flow, in order to increase the velocity and turbulence of coolant flowing over the inside surface of the pipe. The use of a longitudinal spindle and a helical member mounted within the inlet conveying cooling medium to the coolant nozzle is described in U.S. Pat. No. 3,877,865. It is also possible, and may be desirable, to cause the coolant flowing over the outside surface of the pipe, to follow a similar spiral or helical path. Angled or curved positioning elements and/or angled or curved projections extending inwardly from the inner wall of the enclosure, could be used to engender or promote such a helical flow through the space between the outside surface of the pipe and the surrounding enclosure.

(2) Preferred Apparatus for Simultaneous Inside-Outside Quenching of Pipe

The enclosed cylinder quench apparatus described below with reference to FIGS. 6–13 consists of the following main components:

1. A mechanism for delivering an austenitized pipe section to the quench unit and removing the quench pipe section from the quench unit when quenching is complete.

2. A modified elongated cylindrical assembly adapted, as in the case of the first embodiment of cylindrical enclosure described above, to enclose the pipe so as to form an annular space therearound, the pipe being co-axially supported within the enclosing cylinder. The cylinder is specifically dimensioned to allow selected inner and outer flow rates in relation to specific pipe size and pumping capacity of the quench unit. The annular space surrounding the pipe within the cylinder is substantially sealed to minimize leakage of coolant during quenching, both at the quench head and along the length of the cylindrical enclosure.

3. Apparatus to receive the hot pipe, deposit in into and support it centrally within the cylindrical assembly.

4. Apparatus to clamp the pipe at the upstream end thereof to prevent longitudinal movement of the pipe when the quench commences.

5. Nozzle means operable to deliver coolant into the interior of the pipe and around the pipe's outer surface, both the inner and outer flows being in a substantially longitudinal direction. As with the quench unit of U.S. Pat. No. 3,877,685, the inside and outside flow paths can be independently regulated to provide optimal quench conditions.

Housing 12 encloses coolant injection unit 13, comprising an outer nozzle casing 14 and a concentric inner nozzle casing 16. The inner nozzle casing presents an inner quench casing sleeve 18 within which nozzle tip 20 may be moved from a retracted position as shown in solid outline in FIG. 6 to an extended position 20*a*, shown in broken outline.

Figure 7:
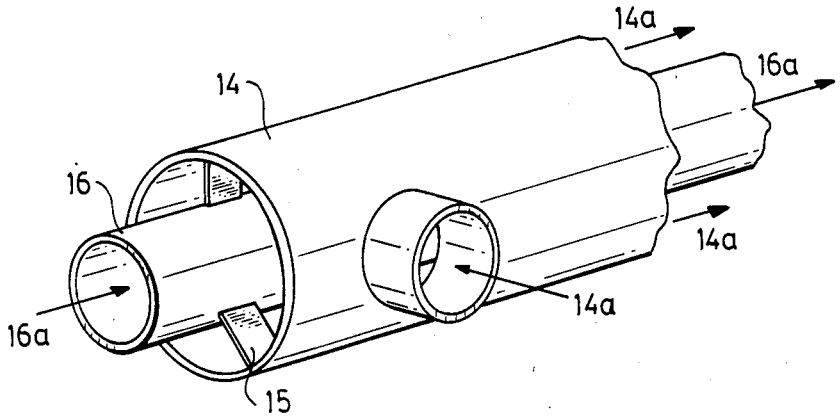
FIG. 7 is a perspective view of the section taken along the line X—X of FIG. 6.

As best seen in the cross-sectional view of FIG. 7, outer nozzle casing 14 and inner nozzle casing 16 do not communicate with each other and are separated by radially extending vanes 15. Coolant enters the inner and outer nozzles through separate flow channels indicated by arrows 14*a* and 16*a*, respectively and the relative flow rates are adjustable by valving, as discussed below in connection with the hydraulic circuitry schematically represented in FIG. 13.

In the retracted position, nozzle tip 20 is spaced from the end of hot pipe section 22 contained and supported within elongated cylindrical enclosure 24. In the extended position 20*a* of nozzle tip 20 it is located within the end of hot pipe 22 and seals against the end thereof.

Figure 6:
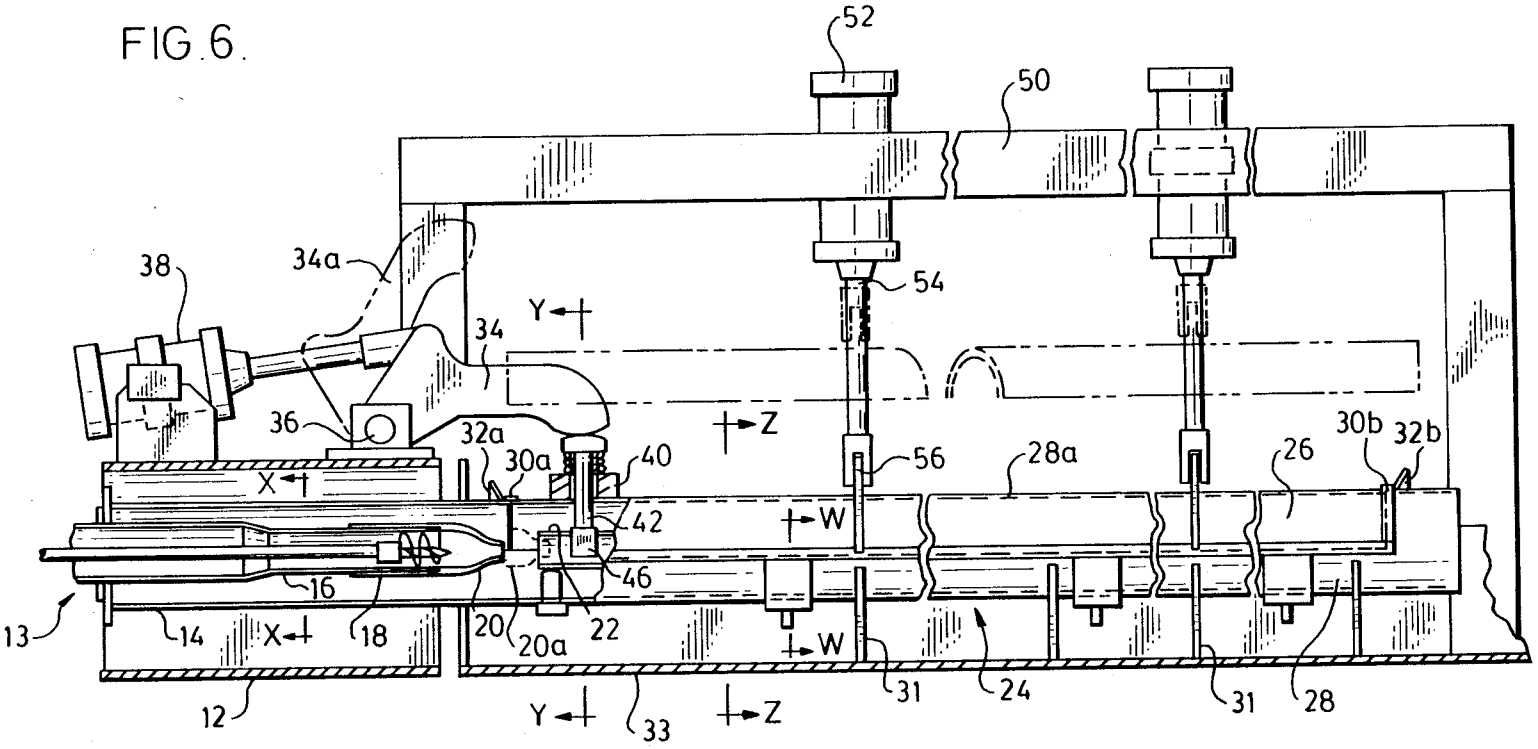
FIG. 6 is a side elevational view, partly in section, of the apparatus of the invention for the inside-outside quenching of a steel pipe section according to the method of the invention.

In FIG. 6, the elongated cylindrical enclosure 24, shown partly broken away along its length, is shown in the closed configuration surrounding pipe section 22 during the quenching process. Cylindrical enclosure 24 comprises upper and lower shell members 26 and 28, respectively. Lower shell member 28 is preferably an integral extension of outer nozzle casing 14 having a semi-cylindrical aperture along its length, illustrated by broken line 28*a*, for receiving pipe from above into the interior of cylindrical enclosure 24. Upper shell member 26 is semi-cylindrical in shape and is dimensioned to cover aperture 28*a* when in the closed configuration; shell member 26 is provided at opposite ends with half-rings 30*a* and 30*b* to provide an overlapping substantially sealing fit with corresponding aperture edge portions of lower shell member 28.

Lower shell member 28 is rigidly supported in a horizontal position by vertical support plates 31 regularly spaced along the floor of an elongated channel 33 which extends under and along the length of cylindrical enclosure 24.

Close fitting and transverse alignment of shell member 26 onto shell member 28 are aided by the provision of a plurality of horizontal guide members 27*a* and 27*b* along the longitudinal mating edges of the upper and lower shell members, respectively. Horizontal guide members 27*a* and 27*b* are downwardly sloping, mating elongated bar segments which meet when cylindrical enclosure 24 is in the closed configuration, as best seen in the cross-sectional views of FIGS. 8 and 10. The end-to-end longitudinal alignment of shell member 26 onto shell member 28 is guided by vertical plate elements 32*a* and 32*b* which prevent longitudinal motion of the upper shell when the upper shell member approaches the lower shell member as the cylindrical enclosure is being closed.

Other structural components of the apparatus depicted in FIG. 6 are as follows: Clamping arm 34 is pivotally mounted to the top of nozzle housing 12 for rotation about pivot axis 36 between an engaged position shown in solid outline and a disengaged position indicated in broken outline at 34*a*. The movement of clamp arm 34 between its engaged and disengaged positions is actuated by pneumatic cylinder 38.

Near its end proximate the coolant injection unit 13, upper shell member 26 of the cylindrical enclosure 24 presents a sleeve 40 opening into the interior of the cylindrical enclosure. Fitted through sleeve 40 is a pin 42 the underside of whose head 43 bears against spring 44. When clamping arm 34 is actuated to move into its engaged position, it bears against the head of pin 42 forcing the pin downwards into the cylindrical enclosure through sleeve 40 against the compression of spring 44.

Figure 8:
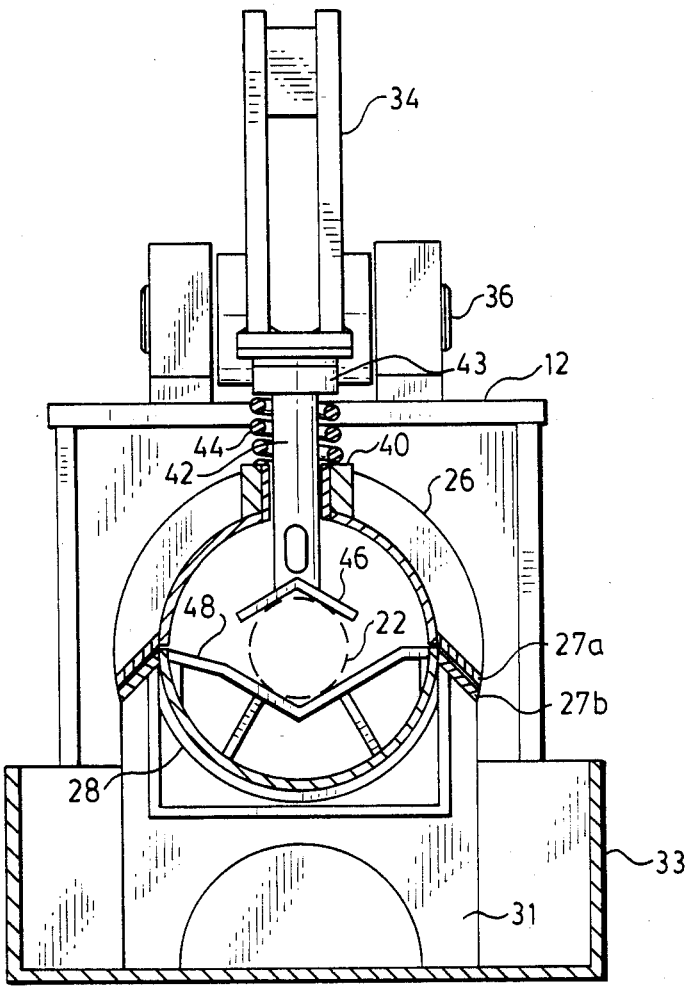
FIG. 8 is a cross-sectional elevation along the line Y—Y of FIG. 6.

As best seen in the cross-sectional view of FIG. 8, pin 42 presents at its lower end an integral inverted V-shaped clamping member 46 which presses the front end of pipe 22 into the trough of a V-shaped pipe support element 48 fitted within lower shell member 28 of the cylindrical enclosure.

The upper and lower clamping members 46, 48 are of a contour selected to hold a pipe of given dimensions in axial alignment with injection nozzle 20.

Fixed above and parallel to the cylindrical enclosure is an elongated beam 50 upon which are mounted a pair of hydraulic cylinders 52 operable to raise and lower upper cylindrical shell member 26 by the retraction and extension, respectively, of rods 54, each having a lower end mounted to a projecting member 56 integral with and extending outwardly from the outer surface of upper shell member 26.

In the described embodiment, the support means disposed within the cylindrical assembly for supporting the steel pipe with its central axis parallel to the central axis of the cylindrical assembly is not an array of spaced positioning elements fixed to the interior walls of the enclosure, but rather comprises a plurality of chain supports positioned at longitudinally spaced locations along the length of the cylindrical space between the underside of the pipe being quenched and the lower shell member.

Figure 9:
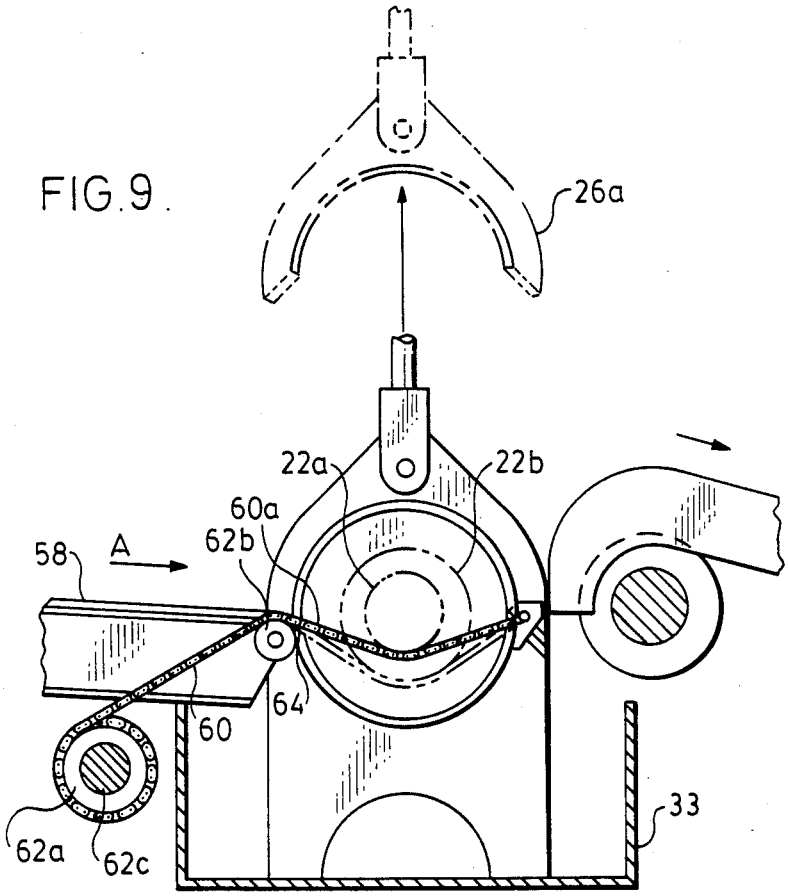
FIG. 9 is a cross-sectional elevation along the line Z—Z of FIG. 6, showing the chain means for supporting a pipe section.
Figure 12:
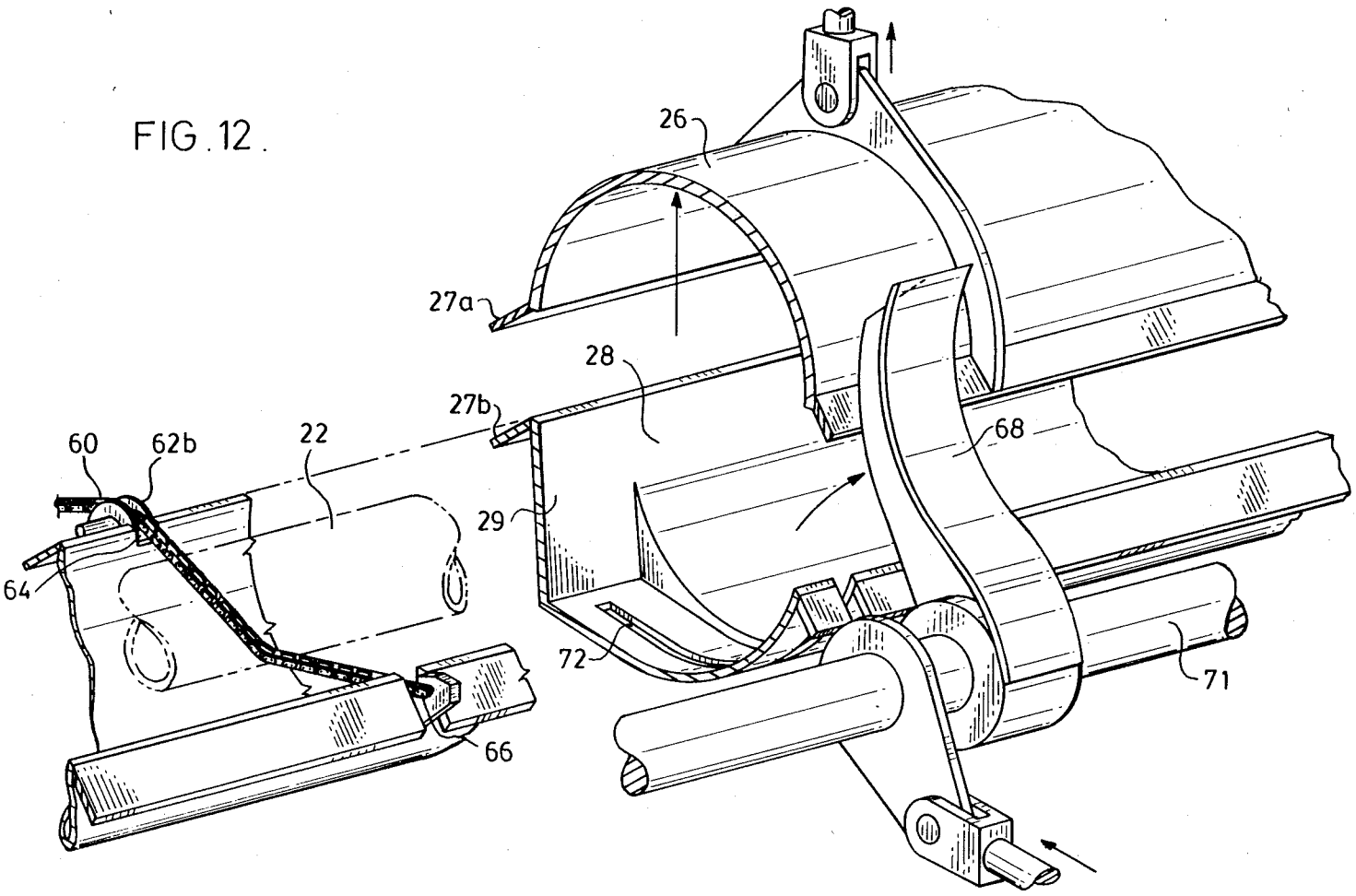
FIG. 12 is an exploded perspective view of the portion of the apparatus seen in FIGS. 9, 10 and 11, illustrating the interaction of the pipe handling and pipe supporting elements of the apparatus.

One such chain support arrangement is best seen in the cross-sectional view of FIG. 9, and the exploded perspective view of FIG. 12. Indicated at 58 is a section of one of the skids along which a hot pipe having its axis parallel to the cylindrical enclosure may roll toward the open enclosure 24 to being received therein for quenching. Arrow A indicates the direction of movement of the pipe before entering the cylindrical assembly. Chain segment 60 passes over driven roller 62*a* and idle roller 62*b* exterior of the cylindrical housing and passes into the housing through close-fitting aperture 64, along the underside of pipe 22 centrally supported with the housing and thence through the wall of the lower shell member where the end of the chain segment is fixed to chain anchor post 66 integral with the lower shell member. Rollers 62*a* along the length of the enclosure are mounted for rotation with shaft 62*c*. Idle rollers 62*b* may be mounted to the ends of skids 58 or, alternatively, to the lower shell member 28.

Roller 62*a* may be selectively adjusted prior to the quenching process, by actuating a motor crank (not shown) to turn shaft 62*c* to play out a length of chain into the cylindrical housing such as will centre the pipe co-axially for uniform quenching with the minimum of pre-quench contact. A small diameter pipe 22 is shown supported by length of chain 60 and a larger diameter pipe 22*a* (shown in dotted outline) supported by length of chain 60*a*. The use of chain supports is advantageous in providing the minimum disruption of the flow of coolant through the annular region between the outer surface of the pipe and the inner walls of the cylindrical housing.

Figure 10:
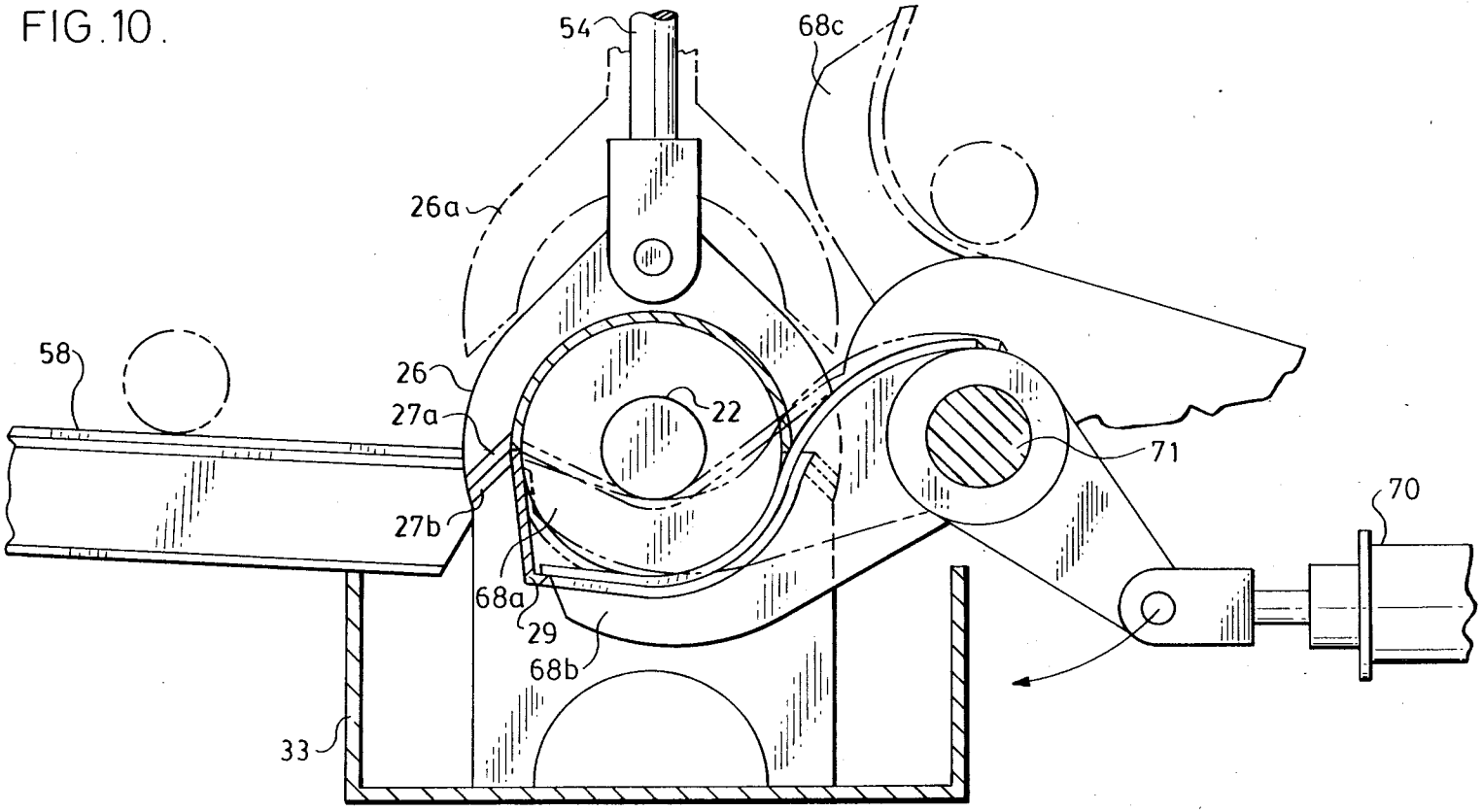
FIG. 10 is a cross-sectional elevation along the line W—W of FIG. 6, showing the pipe-handling arms of the apparatus of the invention.
Figure 11:
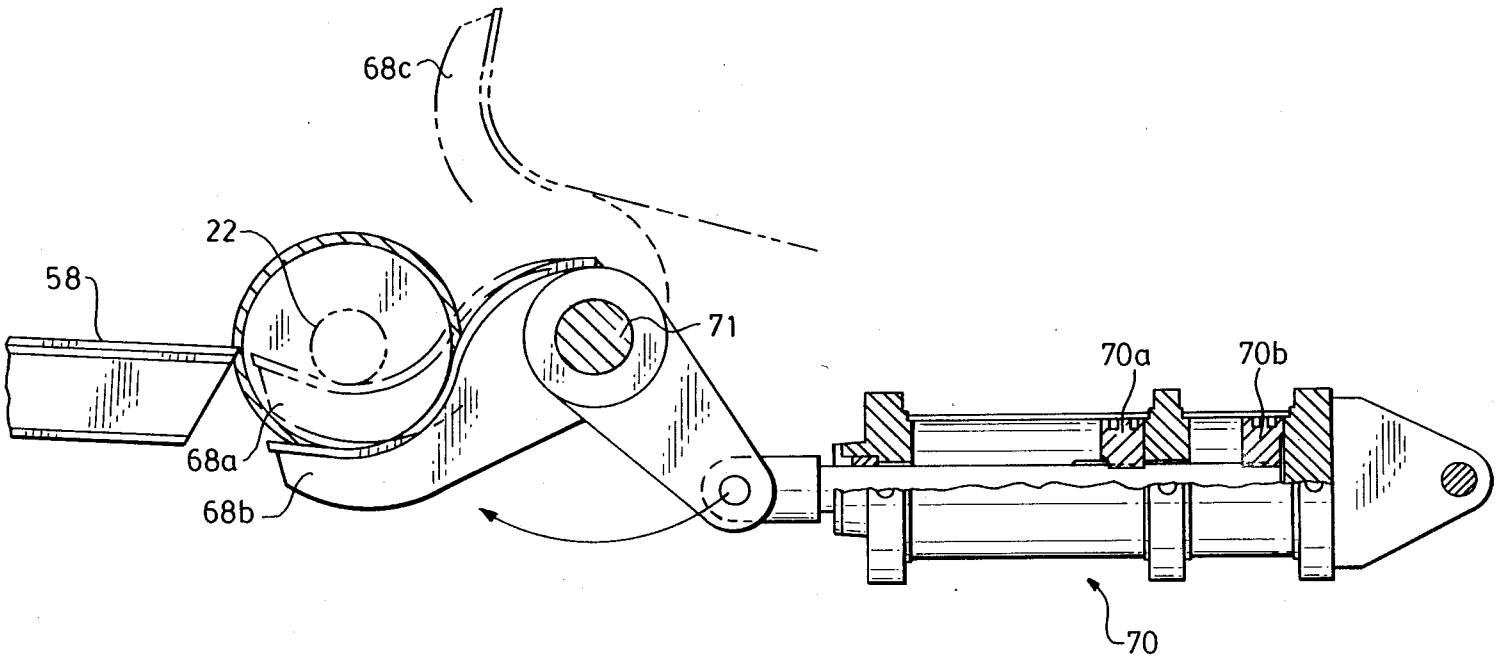
FIG. 11 is a representation of the view of FIG. 10 with the tank and cylindrical housing removed, further illustrating the operation of the pipe-handling arms of the apparatus of the invention.

As best seen in FIGS. 10–12, the pipe handling apparatus used with the current embodiment of cylindrical housing includes a plurality of pivoting arms 68, extending generally transversely of the housing at spaced locations therealong. Pivoting arms 68 are operable by a double-acting pneumatic cylinder mechanism 70 to pivot in concert about axis members 71 between the three operating positions illustrated in FIG. 11, indicating at 68*a*, 68*b* and 68*c*. Pistons 70*a* and 70*b* of mechanism 70 are shown in FIG. 11 both in their retracted positions, corresponding to pivoting arm position 68*b*. The advance of piston 70*b* to its limiting displaced position to the left causes piston 70*a* to be likewise displaced to the left and effects the rotation of the pivoting arm to position 68*a*. Advancing piston 70*a* to its limiting position corresponds to position 68*c* of the pivoting arm, while full retraction of pistons 70*a* and 70*b* places the pivoting arm 68 in position 68*b*.

Prior to the quenching process, when upper shell member 26 is raised above the quench line and positioned as indicated at 26*a*, each pivoting arm 68 is set at position 68*a*, indicated in broken outline, to receive a hot pipe 22 entering the lower half of the cylindrical assembly along skid 58 and to gently guide the hot pipe down into a central position for engagement by the aforementioned chain support. Chain supports 60 and pivoting arms 68 are spaced in adjacent pairs along the length of the cylindrical housing.

Prior to lowering upper shell member 26 to its mating position with the lower shell member, pivoting arms 68 are lowered free of the pipe to their extreme bottom position 68*b*, leaving the pipe supported on chain supports 60 and removing the arms 68 to a position in which there is minimum impediment to water flow. In this position, a lower portion of the pipe handling arm fits through a matching slot 72 in lower cylindrical member 28, the slot being substantially sealed by the close fit of the pipe handling arm therein. Each arm 68 is profiled on the upper surface thereof to conform to the curvature of the cylindrical enclosure, so as to minimize obstruction to the flow of coolant over the pipe's outer surface during quenching.

Subsequent to quenching, when the upper cylindrical shell member is again raised, pipe handling arms 68 are rotated (clockwise in FIGS. 10, 11 and 12) to their uppermost position 68*c*, carrying with them the quenched pipe 22 to an upper kick-out position, whence the pipe rolls free of the entire assembly. Lower cylindrical shell member 28 includes an interior wall portion 29 which allows clearance for the upward motion of the pipe handling arm.

Elongated channel 33, seen in cross-sectional view in FIGS. 9 and 10, extends under and along the length of the cylindrical housing to collect any leakage from the aforementioned points of sealing in the cylindrical housing during quench.

Figure 13:
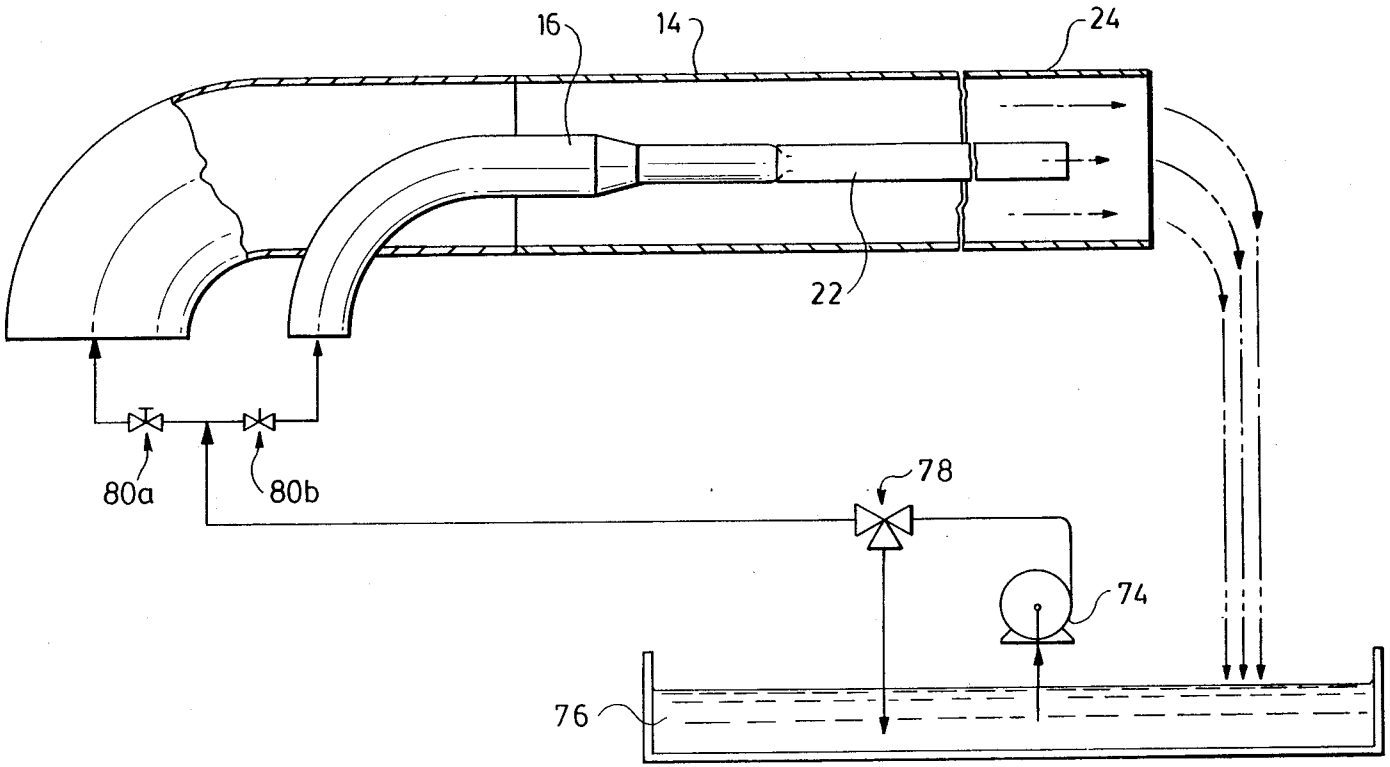
FIG. 13 is a schematic drawing of the hydraulic circuitry and flow path of liquid coolant used in the apparatus of the invention.

The hydraulic circuit for circulating liquid coolant through the apparatus of the present invention is now described in connection with schematic FIG. 13. Liquid coolant is pumped by means of quench pump 74 from reservoir 76. Valve 78 upstream from quench pump 74 is a three-way valve operable selectively to direct the flow of coolant to two-way valves 80*a* and 80*b*, and thence to the injection nozzle conduits 14, 16 in communication with the pipe to be quenched and the cylindrical housing 24, or to return coolant overflow to reservoir 76 between quench cycles.

Valves 80*a* and 80*b* are in separate respective fluid communication with outer nozzle casing 14 and concentered inner nozzle casing 16, from whence water is injected into cylindrical assembly 24 and pipe 22. The flow rates of water injected through the generally annular regions surrounding the pipe enclosed in the cylindrical housing 24 and through the interior of pipe 22 may be separately adjusted by means of valves 80*a* and 80*b* to obtain desired selective relative quench flow rates as discussed above.

The flow of coolant from the pipe and cylindrical assembly downstream of the injection nozzles may be returned to reservoir 76 for circulation.

The sequence of operations in a quench cycle employing the apparatus of FIGS. 6–13 is as follows:

With the upper shell member 26 of the elongated cylindrical assembly in its raised position and pivoting arms 68 in the pipe receiving position 68*a*, a heated pipe, previously longitudinally aligned with the cylindrical assembly, rolls from the furnace exit conveyer along sloped skids toward the quench unit where it rolls onto arms 68 with very little vertical drop or impact to the pipe.

When a sensor (not shown) detects the pipe at the centre line of the quench unit, receiving arms 68 are then lowered gently, easing the hot pipe onto chain supports 60, which have been previously adjusted to support pipe of the dimension being quenched in alignment with the quench access.

Pivoting arms 68 continue lowering to their bottom position, becoming sealing elements in the bottom slots of lower cylindrical shell member 28. In this position, arms 68 are aligned with the bottom of the cylindrical assembly with the profiled contours of the arms matching the cylinder curvature, so as to minimize obstruction to the flow of coolant in the annular region between the pipe and the cylindrical assembly.

As arms 28 are being lowered from the pipe-receiving position to the bottom sealing position, the upper shell member 26 is simultaneously being lowered to mating engagement with lower shell member 28, by the operation of hydraulic cylinders 52.

Once the upper and lower halves of the cylindrical assembly are engaged, clamping arm 34 is actuated by hydraulic cylinder 38 to force the hot pipe down against pipe support element 48 and into alignment with nozzle 20.

Nozzle 20 is then extended to move forward within quench casing sleeve 18 into sealing engagement with the proximate end of the pipe 22.

Simultaneously with the sealing of the pipe 22 to nozzle 20 main quench valve 78 is opened. Valves 80*a* and 80*b*, supplying inner quench conduit 16 and outer annular quench conduit 14, respectively, have been preset, allowing coolant to flow simultaneously through the inside and along the outside of the pipe in a selected flow rate ratio suitable for the particular dimensions and composition of pipe to be quenched. Any leakage from the points of sealing of the cylinder is collected and drained via channel 33.

Alternatively, valves 80*a* and 80*b* may be fully regulated during quenching to obtain the required metallurgical properties. The preset flow rates or flow regulation program are specifically predetermined to obtain the desired metallurgical properties of the pipe to be quenched.

Once the quenching of the pipe is complete, as for example determined by a variable cycle timer (not shown) the main quench valve closes, nozzle 20 retracts, clamping arm 34 is retracted, the upper cylindrical shell member raised and pivoting arms 68 rotated to the upper kick-out position to discharge the pipe onto conveying skid 74. Pivoting arms 68 then return to the intermediate pipe-receiving position in readiness for another quench cycle.

It will be understood from the foregoing description of the claimed apparatus that by the use of this apparatus the heated pipe remains dry at austenitizing temperature until substantially instantaneous commencement of inside and outside flows of coolant allows flow quench flow to be established along the length of the pipe. By this procedure, the problems of "static quench" discussed above are avoided.

The chain support mechanism used in centering the pipe in the second embodiment described above is conducive to a minimum of pre-quench contact between the pipe and supporting means, which can lead to undesirable localized spot quenching. The chains also allow for the minimum disruption of the outside flow path.

Since the flow path of coolant about the outside of the pipe being quenched is closed (unlike channel flow in an immersion quenching system using a cooling tank), increased quenching velocities and a uniform pressurized volume flow around the circumference of the pipe are attainable.

It will also be understood that the apparatus of the invention may be used, where this is desirable, for inside quenching only, outside quenching only or any combination thereof. Both inside and outside flow rates may be preset or fully regulated, and the relative times of onset of the two flows preset or varied as desired to provide a range of quenching conditions.

What is claimed is:

1. Apparatus for hardening an elongated steel pipe section by quenching with a liquid cooling medium, comprising in combination:

(a) a source of liquid cooling medium;

(b) a hollow elongated enclosure of length greater than the length of a pipe section to be quenched and of inside transverse dimensions greater than the outside diameter of such pipe section, and openable to receive such length of pipe, said enclosure comprising an upper shell and a lower shell operable to be assembled in mating engagement to form an enclosure and operable to be separated into an open configuation in which one shell is displaced from the other a sufficient distance to facilitate the introduction of a pipe into the apparatus;

(c) injection means for introducing cooling medium from said source to flow through the interior of a pipe section supported within said enclosure in linear alignment with said injection means, and to flow over the outside surface of such aligned pipe section over the outside surface thereof through the space between the exterior of such aligned pipe section and the interior surface of said enclosure;

(d) supporting means operable to support such pipe section within said enclosure in axial alignment with said injection means, said supporting means comprising a plurality of longitudinally spaced transversely extending adjustable flexible members dimensioned and arranged as to permit a substantially unimpeded flow of cooling medium through said elongated enclosure and being adjustable in length so as to support pipe sections of various diameters in alignment with said injection means;

(e) means for regulating the rate of flow of cooling medium through the inside of a pipe section received in said enclosure in axial alignment with said injection means, relative to the rate of flow of cooling medium over the outside surface of such pipe section;

(f) pipe handling means for receiving a hot pipe section to be quenched and for depositing such pipe onto said supporting means with said enclosure in the open configuration, wherein said pipe handling means is adapted to retract from said supporting means to a position in close proximity to the inner surface of said lower shell when said upper and lower shells are assembled to form said enclosure, thereby leaving such pipe section supported on said supporting means, and for lifting said pipe section free of said enclosure when said upper and lower shells are separated into said open configuration; and (g) securing means for securing a pipe section supported on said supporting means within said enclosure against longitudinal displacement by cooling medium introduced into said enclosure by said injection means.

2. Apparatus as defined in claim 1, wherein said upper and lower shells are substantially semi-cylindrical in configuration and said enclosure is substantially cylindrical in configuration.

3. Apparatus as defined in claim 5, wherein said injection means comprises:

(a) an outer cylindrical casing in communication at one end thereof with said source of cooling medium, facing one end of said cylindrical enclosure and having an inner diameter substantially equal to the inner diameter of said cylindrical enclosure;

(b) an inner cylindrical casing disposed within said cylindrical enclosure and in separate fluid communication therefrom with said source of cooling medium, said inner casing having a nozzle for introducing cooling medium through the tip of said nozzle into the interior of a steel pipe section supported within said enclosure in alignment with said injection means; and (c) means for moving said nozzle between a retracted position in which the tip thereof is spaced from the end of said pipe section and an extended position in which the tip lies sealingly within the end of said pipe section.

4. Apparatus as defined in claim 1, wherein said supporting means comprises:

(a) a plurality of transverse chains extending from outside said enclosure at one side thereof, downwardly into said enclosure and thence upwardly and outside the enclosure at the other side thereof, said chains being spaced in the direction of the length of said enclosure for supporting a pipe section from below; and (b) chain drive means for selectively adjusting the lengths within said enclosure of segments of said transverse chains, so that a pipe section of a given diameter may be supported in axial alignment with said injection means.

5. Apparatus as defined in claim 4, wherein said securing means comprises:

(a) a vertical support member extending upwardly from the inner surface of said lower shell near said first injection means, said vertical support member having a recessed portion for receiving and holding a pipe section introduced into said enclosure for quenching, and dimensioned for alignment of said pipe section with said injection means;

(b) a retractable pressure pin mounted to said upper shell member above said vertical support member and passing closely through an opening provided in said upper shell member, so that pressure exerted on said pin forces said pipe section into the recessed portion of said vertical support member;

(c) a powered clamping arm operable to exert pressure on said pressure pin to force said pipe section into the recessed portion of said vertical support member; and (d) control means operable to actuate said powered clamping arm at a selected interval after introduction of a pipe section into said enclosure and substantially coincidentally with the commencement of injection of cooling medium into and around said pipe.

6. Apparatus as defined in claim 2, wherein said pipe handling means comprises a plurality of transverse arms distributed along the length of said cylindrical enclosure, means mounting said arms for swinging movement and selected positioning of said arms between a first limiting position in which said arms lie within said lower semi-cylindrical shell below the vertical level of a pipe being quenched and a second limiting position in which said arms aare withdrawn from said cylindrical enclosure, each of said arms being concavely contoured and dimensioned to be in close proximity with the inner surface of said lower shell when in said first limiting position, and having a concave end adapted to lift a pipe section from said supporting means and remove such pipe section from the enclosure in its open configuration when said arms are rotated from said first limiting position to said second limiting position.

7. Apparatus as defined in claim 4, wherein said pipe handling means comprises a plurality of transverse arms distributed along the length of said enclosure, means mounting said arms for swinging movement and selected psitioning of said arms between a first limiting position in which said arms lie within said lower shell below the vertical level of a pipe being quenched and a second limiting position in which said arms are withdrawn from said enclosure, each of said arms being contoured and dimensioned to be in close proximity with the inner surface of said lower shell when in said first limiting position, and having a concave end adapted to lift a pipe section from said supporting means and remove such pipe section from the enclosure in its open configuration when said arms are rotated from said first limiting position to said second limiting position.

8. Apparatus as defined in claim 2 wherein said semi-cylindrical shells are provided along their mating surfaces with means for sealing the interior of said cylindrical enclosure along the length thereof, so that cooling medium from said source, introduced under pressure into said elongated space between the inside surface of said enclosure and the outside surface of a pipe section received therein to flow over the outside surface of said pipe section, is substantially prevented from leaking out between said semi-cylindrical shells along the length of said cylindrical enclosure.

9. Apparatus as defined in claim 1, wherein said supporting means and said pipe handling means are spaced in adjacent pairs along the length of said enclosure.

10. Apparatus as defined in claim 1, wherein said means for regulating the rate of flow of liquid cooling medium may be preset prior to quenching or, alternatively, may be selectively varied during quenching to produce desired metallurgical properties of the steel pipe section quenched.

* * * * *

UNITED STATES PATENT AND TRADEMARK OFFICE

Patent No.: 4,803,037

Dated: 7 February 1989

Inventor(s): Robert M. McBain et al.

It is certified that error appears in the above-identified patent and that said Letters Patent is hereby corrected as shown below:

In Claim 3, at Col. 16, line 62, delete "5" and substitute --2--.

Signed and Sealed this

Eighth Day of June, 1993

*Attest:*

Michael K. Kirk

MICHAEL K. KIRK

*Attesting Officer*

*Acting Commissioner of Patents and Trademarks*